US005234364A

United States Patent [19]

Ito

[11] Patent Number: 5,234,364

[45] Date of Patent: Aug. 10, 1993

[54] EXHAUST SYSTEM FOR SMALL PLANING BOAT

[75] Inventor: Kazumasa Ito, Hamamatsu, Japan

[73] Assignee: Sanshin Kogyo Kabushiki Kaisha, Hamamatsu, Japan

[21] Appl. No.: 682,136

[22] Filed: Apr. 8, 1991

[30] Foreign Application Priority Data

Apr. 12, 1990 [JP] Japan ..... 2-97347

[51] Int. Cl.[5] ..... B63B 21/32

[52] U.S. Cl. ..... 440/89; 114/270; 60/310

[58] Field of Search ..... 440/89, 47, 38; 114/270; 60/221, 310, 322; 181/212, 221

[56] References Cited

U.S. PATENT DOCUMENTS

| | | | |
|---|---|---|---|
| 3,827,392 | 8/1974 | Jones | 114/270 |
| 4,002,136 | 1/1977 | Michalak | 181/39 |
| 4,213,414 | 7/1980 | Sato | 115/73 |
| 4,274,357 | 6/1981 | Dawson | 114/270 |
| 4,498,876 | 2/1985 | Zemlicka | 440/88 |
| 4,589,852 | 5/1986 | Price | 440/89 |
| 4,631,032 | 12/1986 | Nishida | 440/47 |
| 4,744,778 | 11/1988 | Porter | 440/89 |
| 4,786,265 | 5/1988 | Porter | 440/89 |
| 4,840,589 | 6/1989 | Breaux | 440/89 |
| 4,989,409 | 2/1991 | Nakase et al. | 440/89 |
| 5,007,870 | 4/1991 | Okubo et al. | 440/89 |
| 5,016,439 | 5/1991 | Nitta | 440/89 |
| 5,022,877 | 6/1991 | Harbert | 440/89 |

FOREIGN PATENT DOCUMENTS

| | | | |
|---|---|---|---|
| 282462 | 9/1988 | European Pat. Off. | 440/89 |
| 63-212199 | 9/1988 | Japan . | |
| 2-6678 | 2/1990 | Japan . | |

*Primary Examiner*—Edwin L. Swinehart
*Attorney, Agent, or Firm*—Ernest A. Beutler

[57] ABSTRACT

A number of embodiments of exhaust systems for marine watercraft, particularly, those of the jet propelled type. The exhaust systems all include an exhaust pipe which terminates in a discharge opening formed in a lower surface of the hull for discharging exhaust gases through the body of water in which the watercraft is operating. In addition, the exhaust pipe has an ascending and descending section with an expansion chamber communicating with the upper portion thereof through an opening so as to accumulate water if the watercraft becomes inverted and to direct the accumulated water back to the exhaust outlet opening when righted so as to preclude water from flowing to the exhaust ports of the engine. The expansion chamber also acts as a silencing device and may comprise a portion of a Helmholtz resonator. Furthermore, a low speed exhaust gas discharge extends from the highest portion of the exhaust pipe to the tunnel in which the jet propulsion unit is contained above the water level therein so as to provide a low speed exhaust gas discharge for discharging exhaust gases when the watercraft is operating at idle or low speeds. Various embodiments show different numbers of Helmholtz resonators and arrangements wherein the low speed exhaust gas discharge communicates with at least one of the Helmholtz resonators.

48 Claims, 9 Drawing Sheets

EXHAUST SYSTEM FOR SMALL PLANING BOAT

BACKGROUND OF THE INVENTION

This invention relates to an exhaust system for a small planing boat and more particularly to an improved exhaust system for a watercraft propelled by an inboard engine, such as a jet propelled watercraft.

In marine propulsion units, it is a common practice to employ the cooling water from the body of water in which the watercraft is operating to cool the powering internal combustion engine. In order to facilitate discharge of the cooling water and also to provide silencing, it has been the practice to discharge the cooling water into the exhaust system of the engine. This procedure is used not only with inboard engines, but also with outboard motors that are water cooled.

Although the aforedescribed system is effective to provide silencing, it has some disadvantages. Specifically, because of the addition of water to the exhaust gases, the use of sound deadening materials such as fiberglass packing cannot be employed. Hence, many conventional forms of exhaust silencing utilized with other types of engines cannot be employed with marine propulsion engines.

Another way in which the exhaust gases in a marine propulsion unit are silenced is by discharging the exhaust gases through an underwater exhaust gas discharge. However, this method of silencing has certain disadvantages caused primarily due to the different speeds at which the watercraft may operate. For example, if the exhaust gases are discharged into the body of water in which the watercraft is operating at a low level when the watercraft is operating at low speeds, then the discharge may be too high and above the water when operating at high speeds. Alternatively, the low discharge may give rise to too high a back pressure in the exhaust gases.

With many types of inboard engines, it is the practice to discharge the exhaust gases through the transom of the watercraft. However, this type of discharge presents the problems as noted in the preceding paragraph.

In connection with jet propelled watercraft, it has been proposed to discharge the exhaust gases into the tunnel in which the jet propulsion unit is positioned. This internal discharge of the exhaust gases can improve silencing efficiency. However, the previously proposed discharges of this type have been partially submerged when operating at low speeds and have been above the water and thus provide minimal silencing when at high speeds.

In addition to the problems aforenoted in connection with exhaust gas discharge from a marine propulsion unit, many types of watercraft, because of their sporting nature, frequently may become overturned or capsized. When this occurs, there is a danger that water in the exhaust system may flow into the engine through its open exhaust ports. This presents obvious difficulties upon restarting.

It is, therefore, a principal object of this invention to provide an improved exhaust system for a marine propulsion unit.

It is a further object of this invention to provide an exhaust system for a marine propulsion unit that provides good silencing under all running conditions.

It is a further object of this invention to provide an exhaust system for a jet propulsion unit which will provide excellent silencing under all running conditions.

It is another object of this invention to provide an exhaust system for a small watercraft that embodies a silencing device and which silencing device also acts as a water trap to trap water in the even the watercraft becomes inverted and to prevent the water from flowing to the engine through the exhaust ports either when inverted or when righted.

SUMMARY OF THE INVENTION

A first feature of this invention is adapted to be embodied in an exhaust system for a watercraft having a hull with an under surface which is wetted during all normal operation of the watercraft. An inboard engine is mounted within the hull and drives a propulsion device for propelling the hull through a body of water. An exhaust system is incorporated for receiving exhaust gases from the engine and discharging them to the atmosphere. In accordance with this feature of the invention, the exhaust system terminates at a downwardly facing opening extending through the hull under surface.

Another feature of the invention is also adapted to be embodied in an exhaust system for a watercraft having a hull and an inboard engine mounted within the hull and driving a propulsion device for propelling the hull through a body of water. An exhaust system receives exhaust gases from the engine and discharges them to the atmosphere through an outlet opening. In accordance with this feature of the invention, an expansion chamber is positioned above a portion of the exhaust system in the normal position of the watercraft and communicates with that portion of the exhaust system through an opening to function as a silencing device during normal watercraft operation and to absorb a volume of water entering the watercraft through the outlet opening if the watercraft is inverted for precluding such water from flowing into the engine.

A further feature of this invention is adapted to be embodied in a jet propelled watercraft having a hull with a tunnel in which a jet propulsion unit is positioned and which jet propulsion unit is powered by an internal combustion engine positioned within the hull. The engine has an exhaust system that is comprised of a main exhaust discharge opening formed in the hull below the normal water level during watercraft operation and a restricted opening into the tunnel above the water level therein under all conditions when the watercraft is upright in the body of water.

DETAILED DESCRIPTION OF THE PREFERRED EMBODIMENTS

Figure 1:
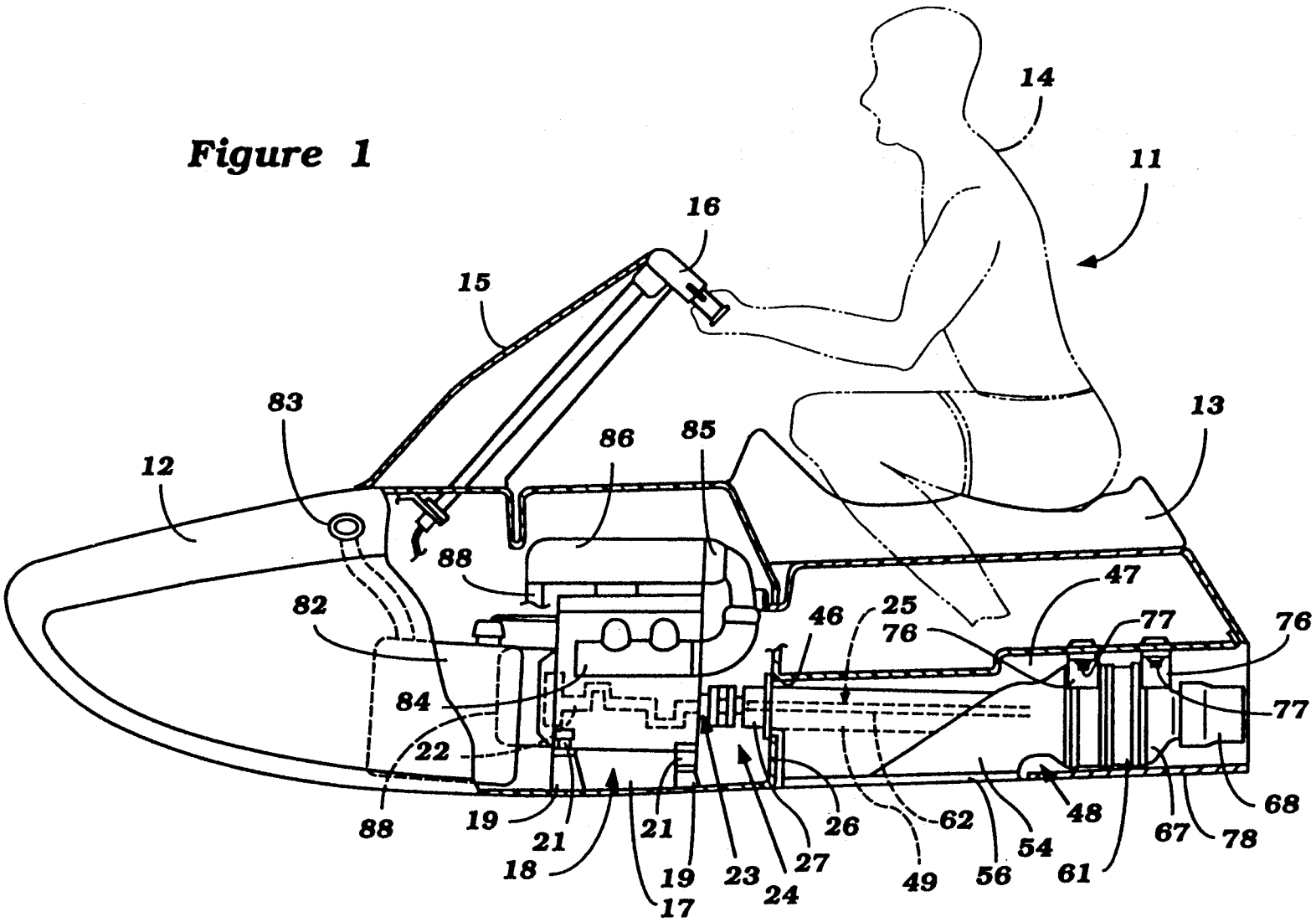
FIG. 1 is a side elevational view of a small watercraft constructed in accordance with a first embodiment of the invention, with portions broken away.

Referring first to the embodiment of FIGS. 1 through 6, a small watercraft constructed in accordance with this embodiment is identified generally by the reference numeral 11 and includes a hull 12 having a rearwardly mounted seat 13 on which a single rider, shown in phantom and identified by the reference numeral 14, is adapted to be seated for operating the watercraft. Although the invention is described in conjunction with such a small watercraft, it will be readily apparent to those skilled in the art that the invention may be employed with other types of watercraft. However, certain facets of the invention have particular utility with a small watercraft of this type, due to the fact that this type of small watercraft may frequently become capsized due to its sporting nature.

A mast 15 is positioned in front of the seat 13 and carries a handlebar 16 for operation of the watercraft 11 and particularly for steering it, in a manner to be described. An engine compartment, indicated generally by the reference numeral 17 is formed by the forward portion of the hull 12 and partially extends beneath the mast 15. An internal combustion engine, indicated generally by the reference numeral 18 is positioned within the engine compartment 17. In the illustrated embodiment, the engine 18 is of the two cylinder in line, two cycle crankcase compression type. It is to be understood, however, that the invention has utility in conjunction with engines of other types.

The engine 18 is mounted on a pair of engine mounts 19 by means including elastic isolators 21. The engine 18 has a crankshaft 22 that has a rearwardly extending exposed portion 23 which is coupled by an elastic coupling 24 to an impeller shaft 25 that extends through a bulkhead 26 of the hull 12. The forward portion of the impeller shaft 25 is contained within a bearing and seal assembly 27.

Figure 3:
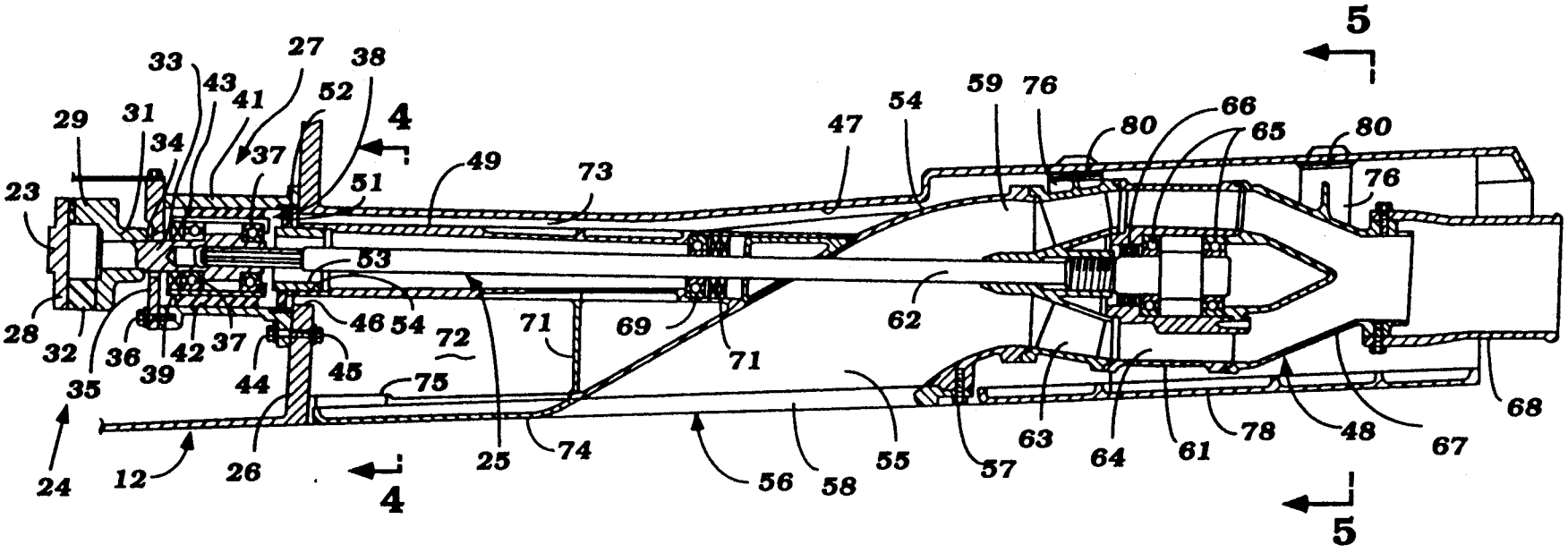
FIG. 3 is a vertical cross sectional view taken through the jet propulsion unit and drive therefor.
Figure 4:
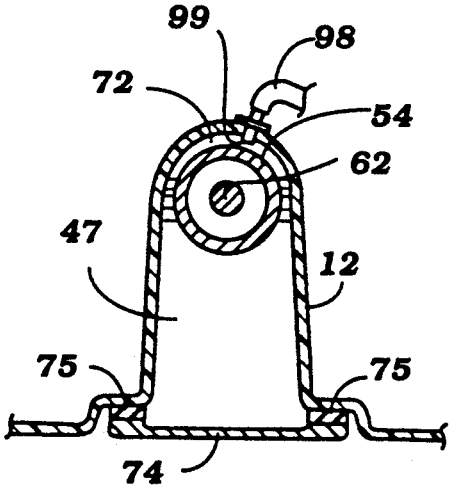
FIG. 4 is a cross sectional view taken along the line 4—4 of FIG. 3.
Figure 5:
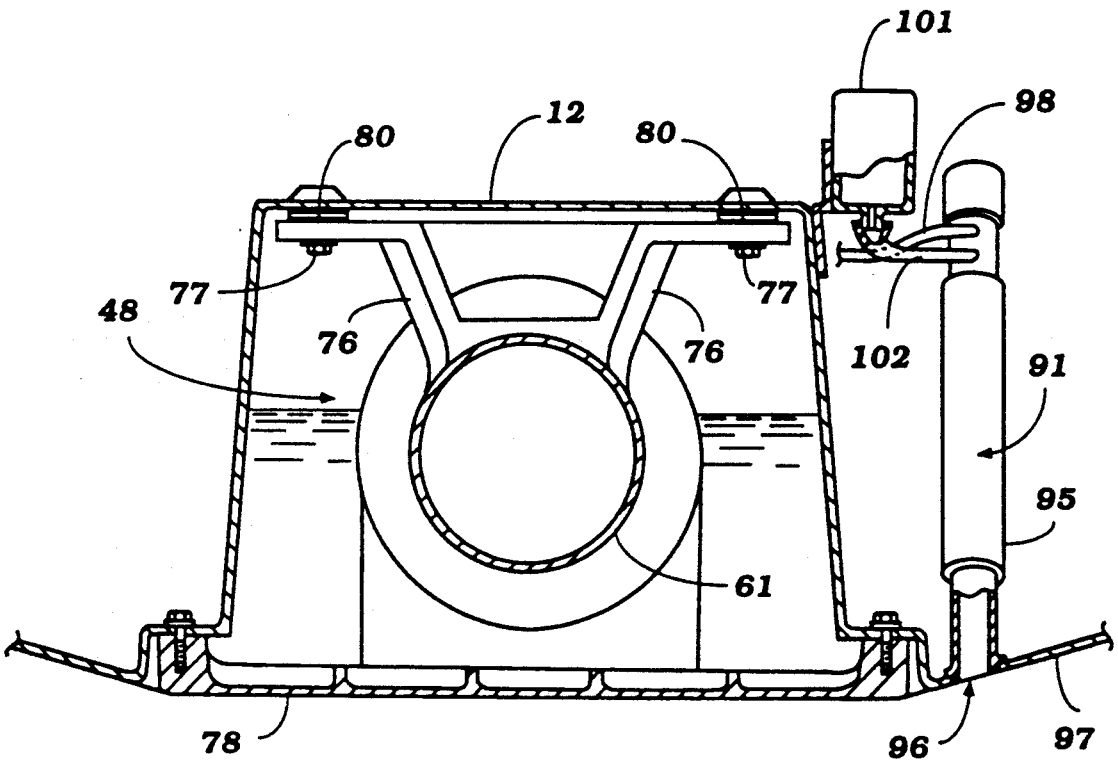
FIG. 5 is a cross sectional view taken along the line 5—5 of FIG. 3.

This drive construction is shown in greater detail in FIG. 3. As may be seen in this figure, the coupling 24 is comprised of a member 28 that is affixed to or formed integrally with the engine output shaft 23 and which cooperates with interdigitation 29 of a second member 31 with elastomeric elements 32 interposed therebetween so as to provide the flexible coupling. The member 31 is affixed to a stub shaft 33 in a suitable manner and which stub shaft 33 extends through an opening 34 formed in a plate 35 that is affixed to the front of the pilot member 27 by threaded fasteners 36. The stub shaft 33 is journaled within the pilot member 27 by means of a pair of spaced apart anti-friction bearings 37 which are contained within a cavity 38 defined by the pilot member 27 and end plate 35. The bearings 37 are supported within a metal sleeve 39 which is, in turn, carried by a cylindrical portion 41 of the pilot part 27 by means of an elastic sleeve 42. A water seal 43 is interposed between the sleeve 39 and the stub shaft 33 for sealing purposes.

The pilot portion 27 is supported on the bulkhead 26 by a plurality of bolts 44 and nuts 45. The bulkhead 26 has an opening 46 through which the impeller shaft 25 extends and the impeller shaft has a splined connection to the stub shaft 33 so as to transmit drive therebetween.

A tunnel, indicated generally by the reference numeral 47, is formed to the rear of the bulkhead 26 and beneath the seat 13. A jet propulsion unit, indicated generally by the reference numeral 48, is contained within this tunnel. This jet propulsion unit 48 includes an outer housing having a cylindrical portion 49 that extends through the bulkhead opening 46 and a water seal 51 extends around this and is held in place by a sleeve 52 that is pressed into the pilot member 27 so as to insure against water leakage forwardly of the bulkhead 26. The seal 51 engages a bushing 53 that is affixed to the interior of the sleeve 49, as by welds 54.

Rearwardly of the tubular portion 49, the jet propulsion unit 48 is provided with a water inlet housing portion 54 having a downwardly facing water inlet opening 55 across which a screen or inlet member 56 is affixed by fasteners 57. The screen or inlet member 56 has slotted openings 58 that permit water to be drawn from the body of water in which the watercraft is operating and to pass through a delivery section 59 which communicates with an impeller housing, indicated generally by the reference numeral 61. The impeller shaft 25 has a portion 62 that extends through the delivery section 59 and which is affixed, in a suitable manner, to an impeller 63. The impeller 63 draws water through the water inlet opening and discharges it past a plurality of straightening vanes 64 formed in the impeller housing 61.

A bearing assembly 65 is supported within the interior of the impeller housing 61 radially inwardly of the straightening vanes 64 and supports the trailing end of the impeller shaft 25. Water seals 66 are provided so as to protect the bearings 65 from water damage.

Water is discharged past the straightening vanes 64 to a discharge nozzle 67 which faces rearwardly and upon which a steering nozzle 68 is supported for pivotal movement about a vertically extending steering axis. The steering nozzle 68 is coupled appropriately to the handlebar 16 for steering the watercraft in a well known manner.

Where the tubular portion 49 meets the water inlet housing 54, there is provided a further support bearing 69 for the impeller shaft 25 and a water seal 71 protects this bearing 69. Forwardly of the bearing 69, the jet propulsion unit housing is provided with a vertically extending wall which defines a chamber 72 that is formed forwardly thereof and beneath the lower surface of the tunnel 48 and rearwardly of the bulkhead 26, for a reason to be described. A restricted opening 73 is formed at the top of the wall 71 so as to communicate the chamber 72 with the area of the tunnel 47 to the rear of the wall 72 and which opens through the rear of the hull 12.

The jet propulsion unit and particularly the water inlet portion 54 has a horizontally extending wall 74 that forms a lower closure for the chamber 72 and which is engaged by an elastic damper 75 for providing part of the resilient support for the jet propulsion unit 48 within the tunnel 47.

The impeller housing 61 of the jet propulsion unit is further supported within the tunnel 47 by a cradle 76 that is suitably affixed to the underside of the hull and specifically the tunnel portion 47 by means of fasteners 77 and elastic isolators 80. A closure plate 78 extends across the rear portion of the tunnel 47 beneath the impeller housing 61 so that the jet propulsion unit is sealed within the tunnel 47 and water will only be drawn through the inlet opening 55 and discharged through the discharge nozzle 67 and steering nozzle 68 without leaking around the outer portion of the jet propulsion unit 48. This insures good efficiency for the pumping unit.

Figure 2:
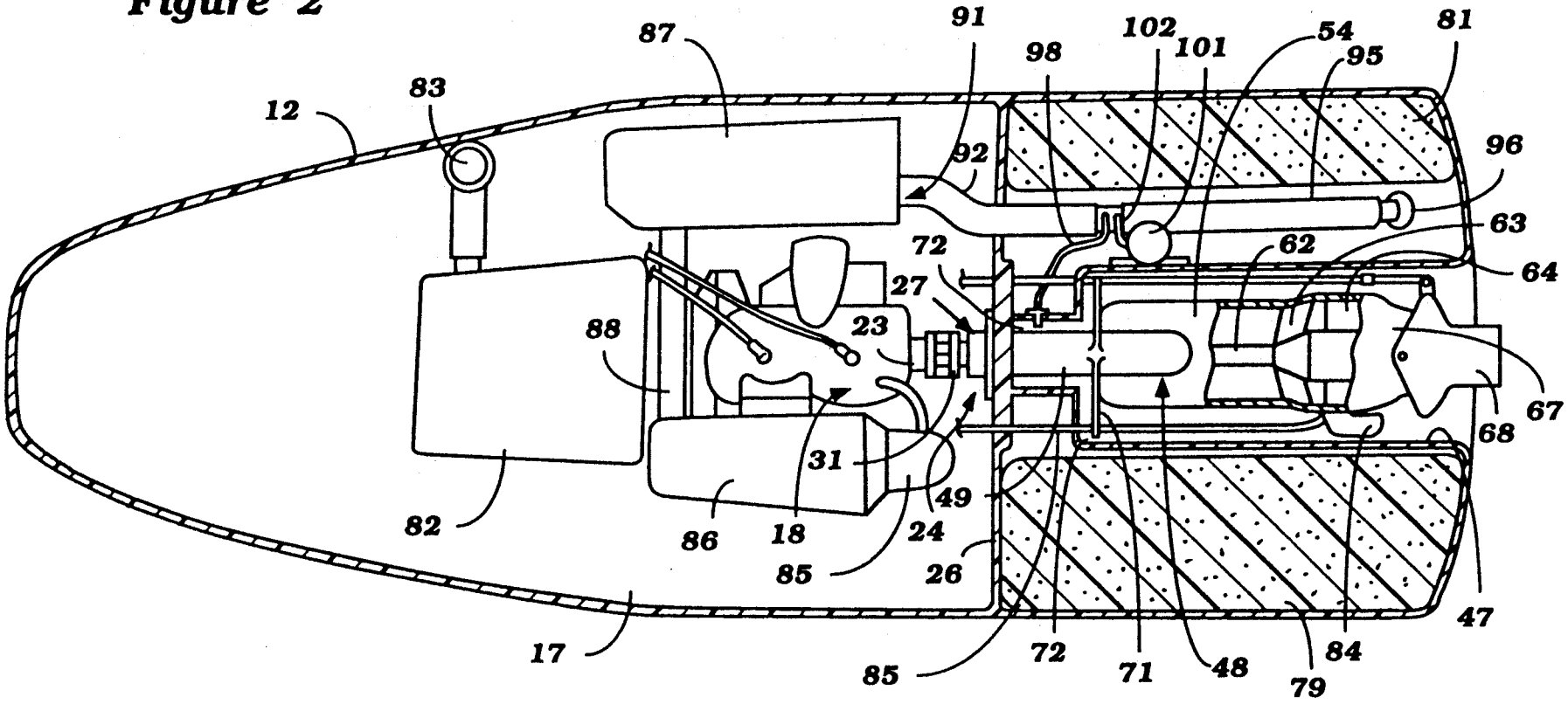
FIG. 2 is a top plan view of the watercraft with the hull shown in cross section and certain other portions broken away.

As may be best seen in FIG. 2, the hull 12 on the sides of the tunnel 47 is filled with bodies 79 and 81 of a buoyant material, such as a foamed plastic or the like. This provides added balance for the watercraft to compensate for the weight of the jet propulsion unit 48.

Referring now again to the engine 18, it is provided with a fuel system that includes a forwardly positioned fuel tank 82 which may be filled through a filler neck 83 that is accessible through the forward deck portion of the hull 12. The fuel tank 82 is positioned on the longitudinal center line of the hull 12 so as to improve the side to side balance and is positioned immediately ahead of the engine 18 in the engine compartment 17.

The engine 18 is water cooled and is supplied with coolant delivered from a pumping section 84 (FIG. 2) of the jet propulsion unit in proximity to the straightening vanes 64 through a conduit 85. The engine 18 may be provided with its own internal cooling pump for circulating the coolant through its various cooling jackets. Since this cooling system may be of any conventional type and forms no part of the invention, further description of it is believed to be unnecessary. However, it should be noted that the coolant that has circulated through the cooling jacket of the engine 18 is discharged back into the body of water in which the watercraft is operating through the exhaust system now to be described.

The exhaust gases are discharged from the exhaust ports of the engine into an exhaust manifold 84 (FIG. 1). Cooling water from the engine cooling jacket may also be discharged in an appropriate manner to this exhaust manifold 84. The exhaust gases and any cooling water then flow through a first exhaust delivery pipe 85 to a first expansion chamber 86 positioned on one side of the engine and which may have a construction as shown in the application for United States Letters Patent entitled "Exhaust System For Small Planing Craft", Ser. No. 593,779, filed Oct. 5, 1990 in my name as co-inventor with Hiroshi Tazaki and Atsushi Sugawara and assigned to the Assignee hereof. The expansion chamber 86, first exhaust pipe section 85 and exhaust manifold 84 lie on one side of the engine 18.

Exhaust gases are delivered from the first expansion chamber 86 to a second expansion chamber 87 which, as may be seen in FIG. 2, lies on the opposite side of the engine 18, through a second exhaust delivery pipe 88. The pipe 88 has a generally U shaped section and the second expansion chamber 87 is provided with a water trap arrangement so as to avoid the likelihood that water can flow back into the exhaust ports of the engine through the exhaust system. This construction may also be as disclosed in aforenoted copending application for U.S. patent Ser. No. 593,779.

The construction of the exhaust system as thus far described may be considered to be conventional. With this type of exhaust system and since cooling water is introduced to the exhaust gases from the engine cooling jacket, the type of silencing devices utilized in conjunction with non-marine engines, such as automotive engines, employing such devices as fiberglass packing cannot be employed for silencing purposes and the silencing must be achieved through the use of the water and expansion chambers.

In accordance with the invention, there is provided an arrangement that permits the use of added silencing devices from those conventionally employed with marine propulsion units and which also further insures against the likelihood of water being able to enter the exhaust ports of the engine, even if the watercraft 11 may be inverted and subsequently righted. To this end, there is provided an exhaust pipe, indicated generally by the reference numeral 91 which serves to convey the exhaust gases and coolant from the second expansion chamber 87 to the body of water in which the watercraft is operating in a submerged location and which also incorporates additional silencing and water entry prevention devices.

Figure 6:
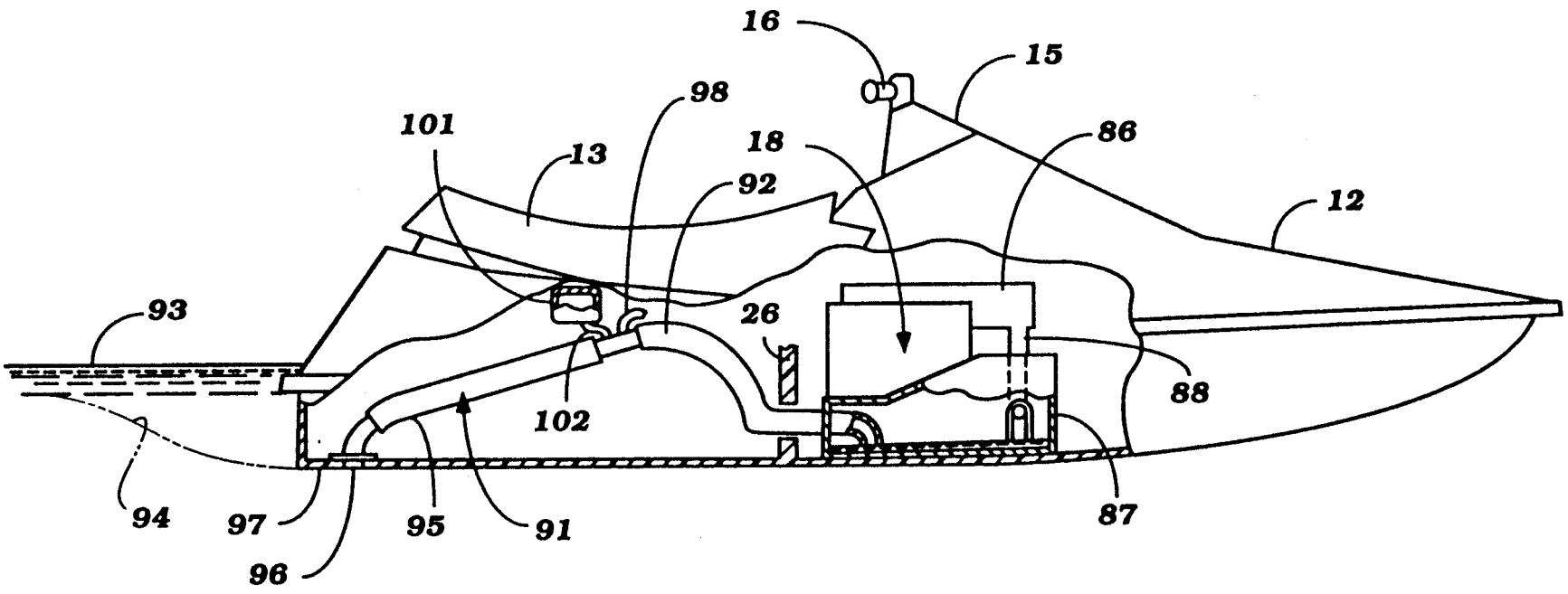
FIG. 6 is a side elevational view, in part similar to FIG. 1, but shows the watercraft from the opposite side and is broken away to show the exhaust system and the water level when operating at idle and when planing at high speed.

The exhaust pipe 91 has a first, generally steeply inclined section 92 that runs from the second expansion chamber 87 rearwardly and in a generally upward direction so as to have an upper portion that is disposed above the water level, as seen in FIG. 6, regardless of whether the watercraft 12 is operating at idle, as shown by the solid line view of the water level 93 or if the watercraft is operating at a planing condition as shown as the dot-dot-dash line 94 in this same figure. From this elevated portion, the exhaust pipe 91 has a gradually downwardly inclined portion 95 that extends toward the rear of the watercraft at one side thereof and which terminates in a downwardly exhaust outlet opening 96 that is formed in the lower surface 97 of the hull. The surface 97 is a surface that is normally wetted under all operating conditions of the watercraft so that the exhaust outlet opening 96 will always be submerged. As a result of this, it will be assured that the exhaust gases will always pass through the body of water in which the watercraft is operating from the outlet 96. This will add further silencing effect to the exhaust gases.

As may be seen from FIG. 6, when the watercraft is operating at idle or low speeds, the outlet opening 96 will be relatively deeply submerged. If all of the exhaust gases were forced to exit through this opening 96, high back pressure in the exhaust system would result in poor engine performance. To avoid this possibility, there is provided a low speed exhaust gas discharge conduit 98 which extends generally from the highest portion of the exhaust pipe 91 and above the water level 93 to a discharge opening in the tunnel 47 and particularly the area 72 thereof formed forwardly of the wall 71. Hence, the combination of the restricted conduit 98 and the tunnel portion 72 forms an expansion chamber through which the slow speed exhaust gas discharge will be silenced. A restricted opening 99 formed at the end of the conduit 98 will insure that there is good silencing at low speeds and that a large volume of exhaust gases will not exit through this path at high speeds. Hence, good silencing will be achieved under all running conditions.

It should be also noted that from the expansion chamber 72, the exhaust gases must pass through the restricted passage 73 (FIG. 3) before it can be discharged rearwardly through the transom of the hull 12. There will hence be a further contraction and expansion of the exhaust gases that adds to the silencing effect.

To further aid in the silencing of the exhaust gases under all running conditions, the exhaust system is also provided with an expansion chamber 101 that communicates with the upper portion of the exhaust pipe 91 through a conduit 102 that functions as a tuning neck so that the expansion chamber 101 and conduit 102 function as a Helmholtz resonator. This Helmholtz resonator may be tuned to silence a more objectionable exhaust frequency and further improve in the silencing.

In addition to providing functioning as Helmholtz resonator, the chamber 101 also will receive water that may enter the exhaust system through the exhaust outlet opening 96 if the watercraft is inverted. It should be noted that the more gradually inclined longer section 95 of the exhaust pipe 91 further insures that more water will be contained in this portion of the exhaust pipe than in the portion 92. When the watercraft is inverted, water will then tend to flow into the expansion chamber 101 rather than into the exhaust pipe section 92. As a result, when the watercraft is returned to its normal position, this water will drain from the expansion chamber 101 back to the body of water in which the watercraft is operating through the pipe section 95 rather than return to the expansion chamber 87 through the pipe section 92. This will offer further insurance that water can never pass back to the exhaust ports of the engine. The device therefore serves a dual purpose.

Figure 7:
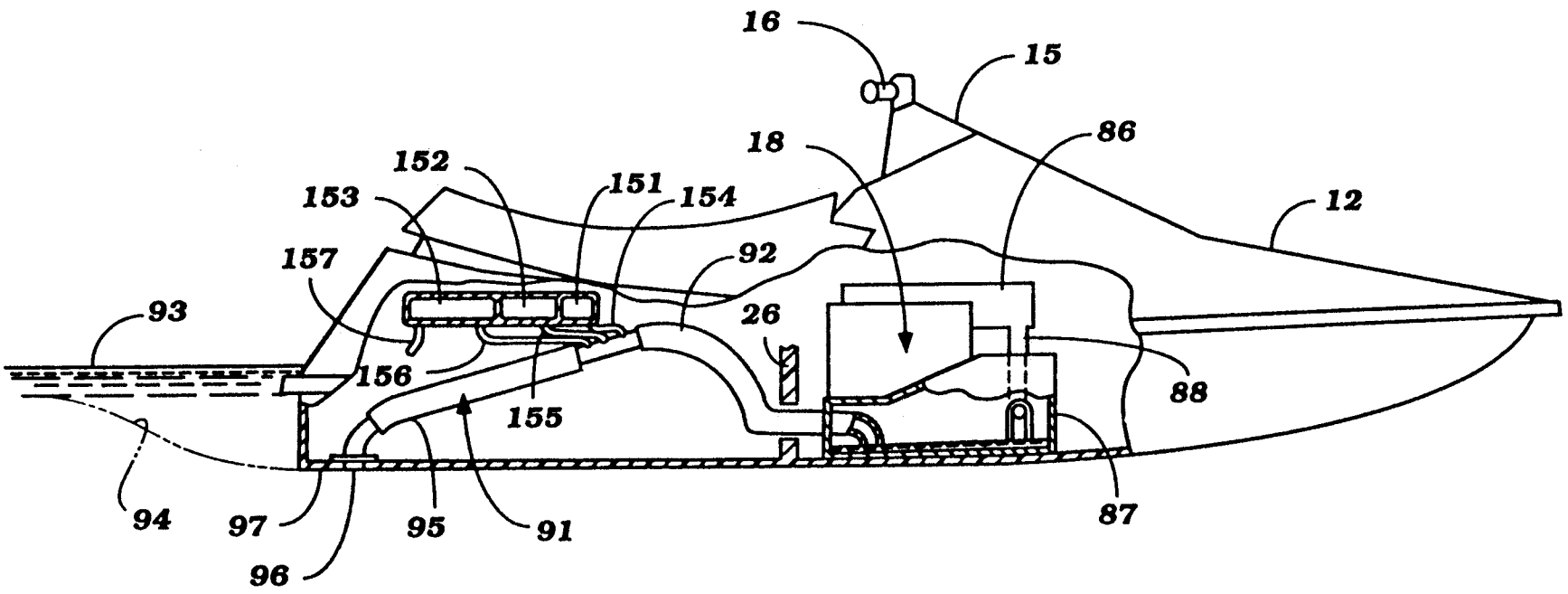
FIG. 7 is a side elevational view, with a portion broken away, similar to FIG. 6, but shows another embodiment of the invention.
Figure 8:
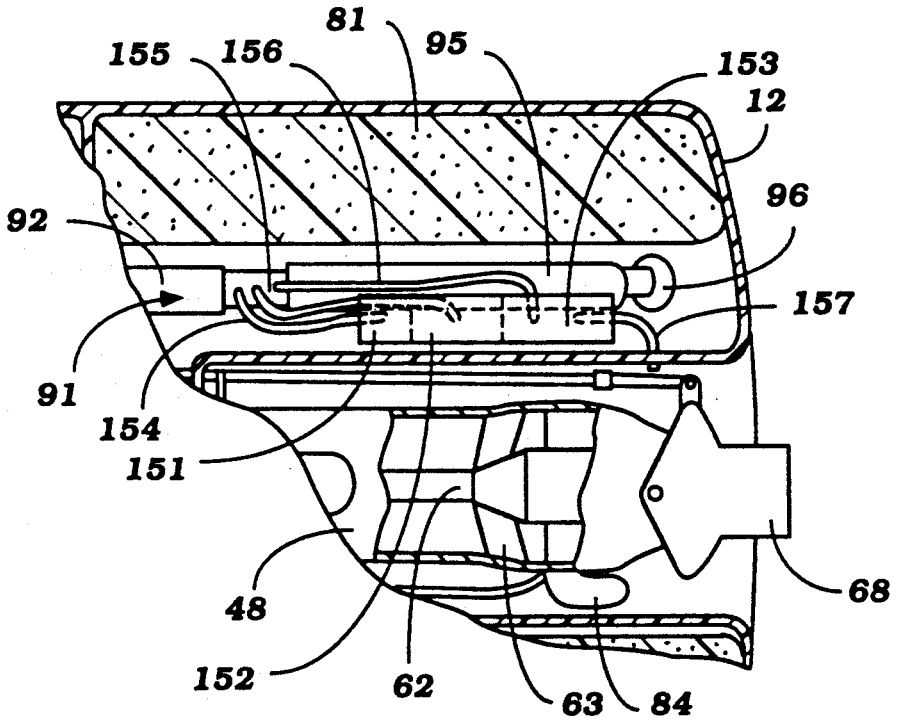
FIG. 8 is a partial cross sectional view, in part similar to FIG. 2, but showing the embodiment of FIG. 7.

In the embodiment as thus far described, the low speed exhaust gas discharge is provided separately from the Helmholtz resonator. However, rather than providing separately the conduit 98 and the Helmholtz resonator 101 and conduit 102, the low speed exhaust gas discharge 98 may be eliminated and a corresponding conduit may be provided between the Helmholtz resonator 101 and the restricted tunnel portion 72 that forms the expansion chamber. When this is done, the Helmholtz resonator can function as a Helmholtz device when running at high speed and as an added expansion chamber for the exhaust gases when running at low speed. Such an arrangement is shown in the embodiment of FIGS. 7 and 8. In this embodiment, there are also provided additional Helmholtz resonators for providing a wider range of silencing. Because this embodiment differs from the previous embodiment only in that regard, only this portion of the system is illustrated. Components which are the same as those of the previously described embodiment have been identified by the same reference numerals and will be described in detail only insofar as is necessary to understand the construction and operation of this embodiment.

In this embodiment, there are provided three expansion chambers, 151, 152 and 153, each of which has a different effective volume. The expansion chambers 151, 152 and 153 communicate with the exhaust pipe 91 at approximately its highest point through conduits 154, 155 and 156. The conduits 154, 155 and 156 may have different lengths and are tuned relative to the volumes of the expansion chambers 152, 153 and 154 so as to provide Helmholtz resonators that will silence different frequencies. In this way, the band of silencing can be further widened from the previously described embodiment.

In addition, the chambers 151, 152 and 153 will provide a larger cumulative volume than the single chamber of the previously described embodiment so as to contain and trap water when the watercraft 11 becomes inverted. Again, this water will drain back through the exhaust pipe section 92 away from the engine rather than back through the section 92 to the engine to further insure against water damage to the engine.

Any one of the expansion chambers 151, 152 and 153 may provide the low speed exhaust gas discharge and in the illustrated embodiment, the chamber 153 is communicated with the tunnel portion 72 by a conduit 157 that has a restricted opening at its end so as to function as a low speed exhaust gas discharge. In addition, the expansion chamber 153 will function as a further expansion chamber under low speed exhaust gas discharge so as to further improve the silencing.

Figure 9:
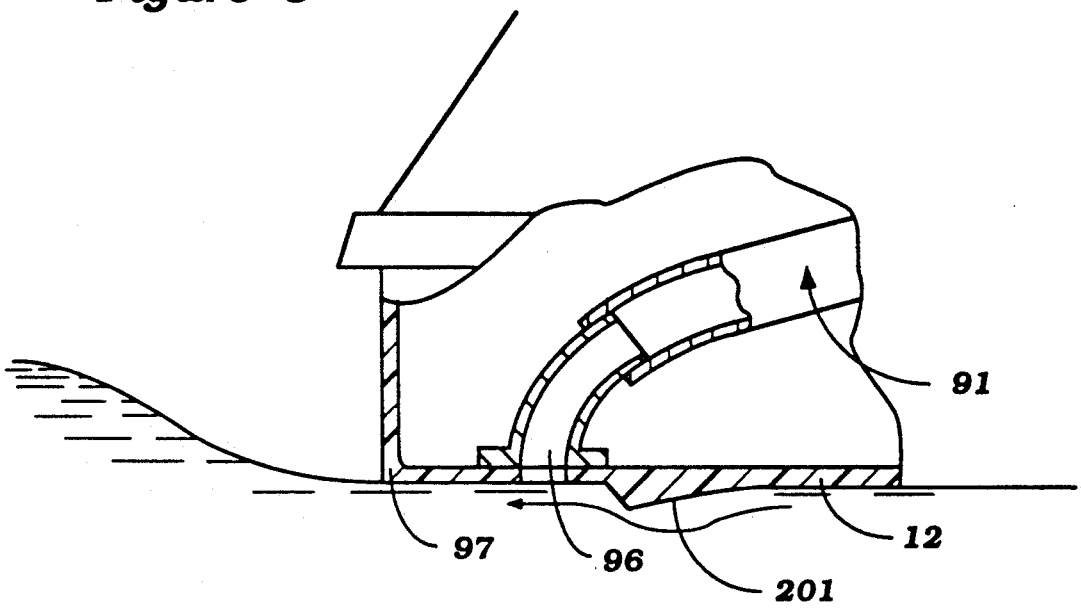
FIG. 9 is a cross sectional view taken through the exhaust discharge of another embodiment of the invention.
Figure 10:
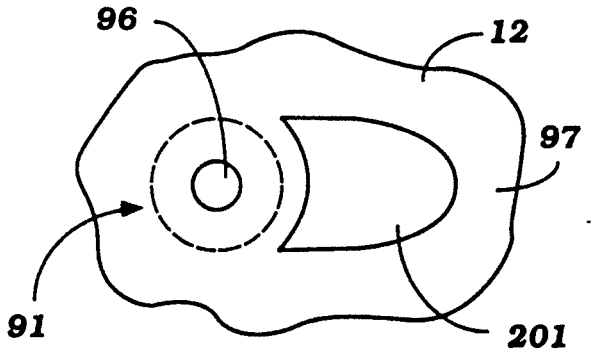
FIG. 10 is a bottom plan view of the embodiment of FIG. 9.

It has been noted that the exhaust gases are discharged, under high speed operation, through the discharge opening 96 in the lower surface 97 of the hull. In order to provide further improvement in the efficiency of the exhaust system, the lower portion of the hull 12 may be provided in proximity with the discharge opening 96 with a device to provide a venturi like action so as to have an extraction force on the exhaust gases. Such an embodiment is shown in FIGS. 9 and 10. As may be seen in these figures, the hull surface 97 is provided with a somewhat tear drop shaped projection 201 that is formed immediately forwardly of the exhaust discharge opening 96 that will create a flow pattern as shown in FIG. 9 that provides a venturi like effect and a reduced pressure at the exhaust discharge opening 96. This will improve the ability of the exhaust gases to be discharged and will increase the performance of the engine.

It should be readily apparent from the foregoing description that the several embodiments of the invention disclosed provide an extremely efficient exhaust system for a marine propulsion unit and one which offers greater silencing capabilities than the previously proposed systems for such watercraft. In addition, good silencing will be achieved both at low and high speeds, without restriction in the exhaust gases. The silencing arrangement also has the added advantage of providing a water trap for trapping water if the watercraft becomes inverted and insuring that this water will not flow to the exhaust ports of the engine when the watercraft is righted. Although a number of embodiments of the invention have been illustrated and described, various changes and modifications may be made without departing from the spirit and scope of the invention, as defined by the appended claims.

I claim:

1. An exhaust system for a watercraft having a hull with an undersurface which is wetted during normal operation of said watercraft, an inboard engine mounted within said hull and driving a propulsion drive for propelling said hull through a body of water, an exhaust system for receiving exhaust gases from said engine and discharging the exhaust gases to the atmosphere, said exhaust system terminating in a downwardly facing exhaust outlet extending through said hull under surface, and an expansion chamber communicating with said exhaust system at a point above the water level and devoid of water when the watercraft is operating in the body of water for receiving water which may enter the exhaust system through the exhaust outlet when the watercraft is inverted and to receive any water in said exhaust system when said watercraft is inverted and for draining of such received water back to the body of water in which the watercraft is operating through said exhaust system exhaust outlet when the watercraft is righted for precluding water from entering the exhaust ports of the engine.

2. An exhaust system as set forth in claim 1 wherein the expansion chamber communicates with the exhaust system through a tuning neck to comprise a Helmholtz resonator when the exhaust system is operating for discharging exhaust gases.

3. An exhaust system as set forth in claim 1 wherein the communication of the expansion chamber with the exhaust system is at a point contiguous to the highest point of the exhaust system.

4. An exhaust system as set forth in claim 3 wherein the exhaust system includes an exhaust pipe having a first steeply inclined section running upwardly from a low point in the hull to the highest point and a second portion extending downwardly at a lesser inclined angle from the highest point to the exhaust outlet opening.

5. An exhaust system as set forth in claim 4 wherein the expansion chamber communicates with the exhaust system through a tuning neck to comprise a Helmholtz resonator when the exhaust system is operating for discharging exhaust gases.

6. An exhaust system as set forth in claim 1 further including means for communicating the exhaust system with the atmosphere at a point above the water level regardless of the condition of operation of the watercraft through a restricted opening for providing a low speed exhaust gas discharge when the exhaust gas outlet is deeply submerged.

7. An exhaust system as set forth in claim 6 wherein the expansion chamber communicates with the exhaust system through a tuning neck to comprise a Helmholtz resonator when the exhaust system is operating for discharging exhaust gases.

8. An exhaust system as set forth in claim 6 wherein the communication of the expansion chamber with the exhaust system is at a point contiguous to the highest point of the exhaust system.

9. An exhaust system as set forth in claim 8 wherein the exhaust system incudes an exhaust pipe having a first steeply inclined section running upwardly from a low point in the hull to the highest point and a second portion extending downward at a lesser inclined angle from the highest point to the exhaust outlet opening.

10. An exhaust system as set forth in claim 9 wherein the expansion chamber communicates with the exhaust system through a tuning neck to comprise a Helmholtz resonator when the exhaust system is operating for discharging exhaust gases.

11. An exhaust system as set forth in claim 1 wherein portion of the hull under surface forwardly of the downwardly facing exhaust opening is formed to effect a venturi effect upon the exhaust outlet when the watercraft is traveling through a body of water.

12. An exhaust system for a watercraft having a hull with a tunnel formed at the rear thereof and surrounded on its sides by an undersurface which is wetted during normal operation of said watercraft, an inboard engine mounted within said hull forwardly of said tunnel, a jet propulsion unit contained within said tunnel and driven by said engine for propelling said hull through a body of water, an exhaust system for receiving exhaust gases from said engine and discharging the exhaust gases to the atmosphere, said exhaust system terminating in a downwardly facing exhaust outlet extending through said hull undersurface on one side of said tunnel, and an expansion chamber within said hull communicating with the exhaust system at a point above the water level when the watercraft is operating in the body of water for receiving water which may enter the exhaust system through the exhaust outlet when the watercraft is inverted and for draining of the received water from said expansion chamber back to the body of water in which the watercraft is operating when the watercraft is righted for precluding water from entering the exhaust ports of the engine.

13. An exhaust system as set forth in claim 12 wherein portion of the hull under surface forwardly of the downwardly facing exhaust opening is formed to effect a venturi effect upon the exhaust outlet when the watercraft is traveling through a body of water.

14. An exhaust system as set forth in claim 12 wherein the expansion chamber communicates with the exhaust system through a tuning neck to comprise a Helmholtz resonator when the exhaust system is operating for discharging exhaust gases.

15. An exhaust system as set forth in claim 12 wherein the point of communication of the expansion chamber with the exhaust system is contiguous to the highest point of the exhaust system.

16. An exhaust system as set forth in claim 15 wherein the exhaust system includes an exhaust pipe having a first steeply inclined section running upwardly from a low point in the hull to the highest point and a second portion extending downwardly at a lesser inclined angle from the highest point to the exhaust outlet opening.

17. An exhaust system as set forth in claim 16 wherein the expansion chamber communicates with the exhaust system through a tuning neck to comprise a Helmholtz resonator when the exhaust system is operating for discharging exhaust gases.

18. An exhaust system as set forth in claim 12 further including means for communicating the exhaust system with the atmosphere through the tunnel at a point above the water level regardless of the condition of operation of the watercraft through a restricted opening for providing a low speed exhaust gas discharge when the exhaust gas outlet is deeply submerged.

19. An exhaust system as set forth in claim 18 wherein the expansion chamber communicates with the exhaust system through a tuning neck to comprise a Helmholtz resonator when the exhaust system is operating for discharging exhaust gases.

20. An exhaust system as set forth in claim 18 wherein the point of communication of the expansion chamber with the exhaust system is contiguous to the highest point of the exhaust system.

21. An exhaust system as set forth in claim 20 wherein the exhaust system includes an exhaust pipe having a first steeply inclined section running upwardly from a low point in the hull to the highest point and a second portion extending downward at a lesser inclined angle from the highest point to the exhaust outlet opening.

22. An exhaust system as set forth in claim 21 wherein the expansion chamber communicates with the exhaust system through a tuning neck to comprise a Helmholtz resonator when the exhaust system is operating for discharging exhaust gases.

23. An exhaust system for a watercraft having a hull, an inboard engine mounted within said hull and driving a propulsion device for propelling said hull through a body of water, and an exhaust system for receiving exhaust gases from said engine and delivering the exhaust gases to the atmosphere through an exhaust outlet opening, an expansion chamber positioned above a portion of said exhaust system and above the water level in the normal position of said watercraft and normally devoid of water and communicating with said portion of said exhaust system through an opening to function as a silencing device during normal watercraft operation and to absorb a volume of water entering said exhaust system through said exhaust outlet opening when said watercraft is inverted for precluding such water from flowing into the engine upon righting to drain said absorbed volume of water through said exhaust outlet opening upon righting.

24. An exhaust system as set forth in claim 23 wherein the expansion chamber communicates with the exhaust system through a tuning neck to comprise a Helmholtz resonator when the exhaust system is operating for discharging exhaust gases.

25. An exhaust system as set forth in claim 23 wherein the point of communication of the expansion chamber with the exhaust system is contiguous to the highest point of the exhaust system.

26. An exhaust system as set forth in claim 25 wherein the exhaust system includes an exhaust pipe having a first steeply inclined section running upwardly from a low point in the hull to the highest point and a second portion extending downward at a lesser inclined angle from the highest point to the exhaust outlet opening.

27. An exhaust system as set forth in claim 26 wherein the expansion chamber communicates with the exhaust system through a tuning neck to comprise a Helmholtz resonator when the exhaust system is operating for discharging exhaust gases.

28. An exhaust system as set forth in claim 23 further including means for communicating the exhaust system with the atmosphere at a point above the water level regardless of the condition of operation of the watercraft through a restricted opening for providing a low speed exhaust gas discharge when the exhaust gas outlet is deeply submerged.

29. An exhaust system as set forth in claim 28 wherein the exhaust system communicates with the atmosphere through the expansion chamber.

30. An exhaust system as set forth in claim 28 wherein the expansion chamber communicates with the exhaust system through a tuning neck to comprise a Helmholtz resonator when the exhaust system is operating for discharging exhaust gases.

31. An exhaust system as set forth in claim 28 wherein the point of communication of the expansion chamber with the exhaust system is contiguous to the highest point of the exhaust system.

32. An exhaust system as set forth in claim 31 wherein the exhaust system includes an exhaust pipe having a first steeply inclined section running upwardly from a low point in the hull to the highest point and a second portion extending downwardly at a lesser inclined angle from the highest point to the exhaust outlet opening.

33. An exhaust system as set forth in claim 32 wherein the expansion chamber communicates with the exhaust system through a tuning neck to comprise a Helmholtz resonator when the exhaust system is operating for discharging exhaust gases.

34. An exhaust system as set forth in claim 23 further including means for communicating the exhaust system with the atmosphere at a point above the water level regardless of the condition of operation of the watercraft through a restricted opening for providing a low speed exhaust gas discharge when the exhaust gas outlet is deeply submerged.

35. An exhaust system as set forth in claim 34 wherein the exhaust system communicates with the atmosphere through the expansion chamber.

36. An exhaust system as set forth in claim 23 wherein the propulsion device comprises a jet propulsion unit contained within a tunnel formed on the underside of the hull.

37. An exhaust system as set forth in claim 36 wherein the expansion chamber communicates with the exhaust system through a tuning neck to comprise a Helmholtz resonator when the exhaust system is operating for discharging exhaust gases.

38. An exhaust system as set forth in claim 23 wherein the point of communication of the expansion chamber with the exhaust system is contiguous to the highest point of the exhaust system.

39. An exhaust system as set forth in claim 38 wherein the exhaust system includes an exhaust pipe having a first steeply inclined section running upwardly from a low point in the hull to the highest point and a second portion extending downwardly at a lesser inclined angle from the highest point to the exhaust outlet opening.

40. An exhaust system as set forth in claim 39 wherein the expansion chamber communicates with the exhaust system through a tuning neck to comprise a Helmholtz resonator when the exhaust system is operating for discharging exhaust gases.

41. A jet propelled watercraft comprising a hull defining a tunnel portion on its undersurface, a jet propulsion unit mounted in said tunnel, an engine mounted within said hull and driving said jet propulsion unit for powering said watercraft, an exhaust system for discharging exhaust gases from said engine to the atmosphere comprising a high speed exhaust gas discharge terminating in a discharge opening in said hull below the level of water in which the watercraft is operating under all normal watercraft operating conditions, and a low speed exhaust gas discharge communicating said exhaust system with said tunnel at a point above the water level therein under all normal running conditions of said watercraft.

42. A jet propelled watercraft as set forth in claim 40 further including an expansion chamber communicating with the exhaust system at a point above the water level in which the jet propelled watercraft is operating.

43. A jet propelled watercraft as set forth in claim 41 wherein the low speed exhaust gas discharge communicates the exhaust system with the tunnel through the expansion chamber.

44. A jet propelled watercraft as set forth in claim 42 further including a restriction positioned between the expansion chamber and the tunnel in the low speed exhaust gas discharge for restricting the flow of exhaust gases into the tunnel.

45. A jet propelled watercraft as set forth in claim 41 wherein the exhaust system includes an exhaust pipe having a first section extending upwardly from a point low in the hull to an elevated position above the water level within the tunnel and a second portion extending down from the upper end of the first portion to the high speed exhaust gas discharge opening and wherein the low speed exhaust gas discharge communicates with the exhaust pipe contiguous to the elevated position.

46. A jet propelled watercraft as set forth in claim 44 further including an expansion chamber contained within the hull and receiving the exhaust gases from the engine and delivering them to the exhaust pipe.

47. A jet propelled watercraft as set forth in claim 45 further including a second expansion chamber and water separator which receives the exhaust gases from the first mentioned expansion chamber and delivers them to the exhaust pipe.

48. A jet propelled watercraft as set forth in claim 46 wherein the first mentioned expansion chamber and the second expansion chamber are positioned on opposite transverse sides of the engine within the hull.

* * * * *